US010852114B2

(12) United States Patent
Norris et al.

(10) Patent No.: US 10,852,114 B2
(45) Date of Patent: Dec. 1, 2020

(54) ADHESIVE-CARRYING ENTANGLING PROJECTILES AND SYSTEMS FOR THEIR USE

(71) Applicant: Wrap Technologies, Inc., Las Vegas, NV (US)

(72) Inventors: Elwood Norris, Poway, CA (US); John Bailey, Poway, CA (US)

(73) Assignee: Wrap Technologies, Inc., Las Vegas, NV (US)

( * ) Notice: Subject to any disclaimer, the term of this patent is extended or adjusted under 35 U.S.C. 154(b) by 0 days.

(21) Appl. No.: 16/502,921

(22) Filed: Jul. 3, 2019

(65) Prior Publication Data

US 2020/0018583 A1 Jan. 16, 2020

Related U.S. Application Data

(60) Provisional application No. 62/693,575, filed on Jul. 3, 2018.

(51) Int. Cl.
*F42B 12/66* (2006.01)

(52) U.S. Cl.
CPC ..... *F42B 12/66* (2013.01)

(58) Field of Classification Search
CPC ..... F42B 15/66; F42B 15/10; F41H 13/0006; F41B 12/66
USPC ..... 102/502, 504
See application file for complete search history.

(56) References Cited

U.S. PATENT DOCUMENTS 34,626 A 3/1862 Ely
34,628 A 3/1862 Gault
35,734 A 6/1862 Gault
39,282 A 7/1863 Ganster
271,825 A 2/1883 Fiske
347,988 A 8/1886 Boyd
1,070,582 A 8/1913 Browning
1,151,070 A 8/1915 Victory
1,198,035 A 9/1916 Huntington
1,211,001 A 1/1917 Steinmetz
1,217,415 A 2/1917 Colomyjczuk
1,229,421 A 6/1917 Downs
1,276,689 A 8/1918 Poudrier
1,304,857 A 5/1919 Davis
1,343,747 A 6/1920 Radakovich
1,488,182 A 3/1924 Whelton
1,536,164 A 5/1925 Tainton (Continued)

FOREIGN PATENT DOCUMENTS

CA 2162221 A1 5/1996

OTHER PUBLICATIONS

PCT Application No. PCT/US18/56068; Filing Date Oct. 16, 2018; Elwood Norris, International Search Report; dated Jan. 15, 2019; 11 Pages.

(Continued)

*Primary Examiner* — Bret Hayes
(74) *Attorney, Agent, or Firm* — Jason Jones

(57) ABSTRACT

An entangling projectile for use in a projectile deployment system includes a pair of pellets, a flexible tether connecting the pellets, and an engagement adhesive. The engagement adhesive is applied to at least a portion of one of the pair of pellets or the tether and is operable to adhesively engage the skin or clothing of a subject engaged by the entangling projectile.

12 Claims, 11 Drawing Sheets

(56) References Cited

U.S. PATENT DOCUMENTS 2,354,451 A 7/1944 Forbes
2,372,383 A 3/1945 Lee
2,373,363 A 4/1945 Wellcome
2,373,364 A 4/1945 Wellcome
2,455,784 A 12/1948 Lapsensohn
2,611,340 A 9/1952 Manning
2,668,499 A 2/1954 Mourlaque
2,797,924 A 7/1957 Stewart
3,085,510 A 4/1963 Campbell
3,340,642 A 9/1967 Vasiljevic
3,484,665 A 12/1969 Mountjoy et al.
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldie et al.
4,166,619 A 9/1979 Bergmann et al.
4,193,386 A 3/1980 Rossi
4,253,132 A 2/1981 Cover
4,318,389 A 3/1982 Kiss, Jr.
4,466,417 A 8/1984 Mulot et al.
4,559,737 A 12/1985 Washington
4,656,947 A 4/1987 Gordon et al.
4,664,034 A 5/1987 Christian
4,750,692 A 6/1988 Howard
4,752,539 A 6/1988 Vatter
4,912,867 A 4/1990 Dukes, Jr.
4,912,869 A 4/1990 Govett
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A 10/1995 Hobbs, II
5,561,263 A 10/1996 Baillod
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,283,037 B1 9/2001 Sclafani
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 5/2006 Smith et al.
7,065,915 B2 6/2006 Chang
7,075,770 B1 7/2006 Smith
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
7,412,975 B2 8/2008 Dillon, Jr.
7,444,939 B2 11/2008 McNulty et al.
7,444,940 B2 11/2008 Kapeles et al.
7,640,839 B2 1/2010 McNulty, Jr.
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin
7,950,329 B1 5/2011 Nemtyshkin et al.
7,984,676 B1 7/2011 Gavin et al.
8,015,905 B2 9/2011 Park
8,024,889 B2 9/2011 Bunker
8,082,199 B2 12/2011 Kwok
8,141,493 B1 3/2012 Kuchman
8,186,276 B1 5/2012 Olden et al.
8,231,474 B2 7/2012 Stethem
8,245,617 B2 8/2012 Martinez et al.
8,261,666 B2 9/2012 Garg
8,281,776 B2 10/2012 Körver et al.
8,339,763 B2 12/2012 McNulty, Jr.
8,441,771 B2 5/2013 Hinz et al.
8,547,679 B2 10/2013 Gavin
8,561,516 B2 10/2013 Martinez et al.
8,601,928 B2 12/2013 Martinez et al.
8,671,841 B2 3/2014 Raquin et al.
8,695,578 B2 4/2014 Olden et al.
8,677,675 B2 5/2014 Koch
8,757,039 B2 6/2014 Martinez et al.
8,857,305 B1 10/2014 Tseng
8,881,654 B2 11/2014 Seecamp
8,896,982 B2 11/2014 Beecher et al.
8,899,139 B2 12/2014 Brill et al.
9,025,304 B2 5/2015 Brundula et al.
9,134,099 B2 9/2015 Tseng
9,157,694 B1 10/2015 Tseng
9,220,246 B1 12/2015 Roman
9,255,765 B2 2/2016 Nelson
9,303,942 B2 4/2016 Sievers
9,335,119 B2 5/2016 Werner
9,414,578 B2 8/2016 Thornbrough
9,581,417 B2 2/2017 Tseng
9,638,498 B2 5/2017 Chang
10,107,599 B2 10/2018 Norris et al.
2002/0134365 A1 9/2002 Gray
2002/0170418 A1 11/2002 McNulty, Jr. et al.
2003/0106415 A1 6/2003 Smith
2003/0165041 A1 9/2003 Stethem
2003/0165042 A1 9/2003 Stethem
2004/0245338 A1 12/2004 Poloniewicz
2005/0166441 A1 8/2005 Mattox
2006/0112574 A1 6/2006 Hodge et al.
2006/0120009 A1 6/2006 Chudy, II
2006/0254108 A1 11/2006 Park
2007/0019358 A1 1/2007 Kroll
2007/0101893 A1 5/2007 Shalev et al.
2007/0264079 A1 11/2007 Martinez et al.
2009/0025597 A1* 1/2009 Kapeles ..... F41H 13/0025 102/464
2009/0084284 A1 4/2009 Martinez et al.
2010/0126483 A1 5/2010 Makowski
2010/0315756 A1 12/2010 Gavin
2011/0005373 A1 1/2011 Martinez et al.
2011/0271825 A1 11/2011 Howland
2012/0019975 A1 1/2012 Hanchett et al.
2012/0170167 A1 7/2012 Beechey et al.
2012/0210904 A1 8/2012 Merems
2014/0331984 A1 11/2014 Brahler, II et al.
2014/0334058 A1 11/2014 Galvan et al.
2015/0075073 A1 3/2015 Sylvester
2015/0168107 A1 6/2015 Tseng
2015/0241180 A1 8/2015 Pruett

(56) References Cited

U.S. PATENT DOCUMENTS

| | | | |
|---|---|---|---|
| 2015/0276351 | A1 | 10/2015 | Pekarek et al. |
| 2015/0316345 | A1 | 11/2015 | Brahler, II et al. |
| 2016/0010949 | A1 | 1/2016 | Teetzel et al. |
| 2016/0161225 | A1 | 6/2016 | Searle et al. |
| 2016/0238350 | A1 | 8/2016 | Tseng |
| 2017/0029816 | A1 | 2/2017 | Swiderski |
| 2017/0160060 | A1 | 6/2017 | Purvis |
| 2017/0241751 | A1 | 8/2017 | Nerheim |
| 2017/0276460 | A1* | 9/2017 | Norris ..... F41H 13/0006 |
| 2017/0276461 | A1 | 9/2017 | Norris |
| 2018/0003462 | A1 | 1/2018 | Chavez |
| 2018/0292172 | A1 | 10/2018 | Ehrlich |

OTHER PUBLICATIONS

European Search Report Application No. 17824657.5-1011, dated Apr. 11, 2019; 9 Pages.

* cited by examiner

ADHESIVE-CARRYING ENTANGLING PROJECTILES AND SYSTEMS FOR THEIR USE

PRIORITY CLAIM

Priority is claimed of and to U.S. Provisional Patent Application Ser. No. 62/693,575, filed Jul. 3, 2018, which is hereby incorporated herein by reference in its entirety.

RELATED APPLICATIONS

This application is related to U.S. Provisional Patent Application Ser. No. 62/524,499, filed Jun. 24, 2017, and U.S. patent application Ser. No. 15/081,440, filed Mar. 25, 2016, and U.S. patent application Ser. No. 15/399,537, filed Jan. 5, 2017, and U.S. patent application Ser. No. 15/467,958, filed Mar. 23, 2017, each of which is hereby incorporated herein by reference in its entirety.

BACKGROUND OF THE INVENTION

Field of the Invention

The present invention relates generally to non-lethal, ranged weapons systems to aid in impeding or subduing hostile, fleeing or non-compliant persons of interest.

Related Art

It has been recognized for some time that police and military personnel can benefit from the use of weapons and devices other than firearms to deal with some hostile situations. While firearms are necessary tools in law enforcement, they provide a level of force that is sometimes unwarranted. In many cases, law enforcement personnel may wish to deal with a situation without resorting to use of a firearm. It is generally accepted, however, that engaging in hand-to-hand combat is not a desirable choice.

For at least these reasons, ranged engagement devices such as the Taser™ have been developed to provide an alternative. While such electrical muscular disruption ("EMD") weapons have been used with some success, debates continue as to whether such devices are as safe as claimed or are an appropriate level of force for many situations. Other ranged engagement solutions, such as mace or pepper spray, are very limited in range and are often criticized for the pain caused to subjects and the potential for such solutions to affect police or bystanders.

As such, designers continue to seek non-lethal solutions that can be effectively used by police or law enforcement to impede or subdue fleeing or non-compliant subjects.

SUMMARY OF THE INVENTION

In accordance with one aspect of the technology, an entangling projectile is provided for use in a projectile deployment system. The entangling projectile can include a pair of pellets and a flexible tether connecting the pellets. An engagement adhesive can be applied to at least a portion of one of the pair of pellets or the tether. The engagement adhesive can be operable to adhesively engage the skin or clothing of a subject engaged by the entangling projectile.

In accordance with another aspect of the technology, an entangling projectile for use in a projectile deployment system is provided. The entangling projectile can include a pair of pellets and a flexible tether connecting the pellets. An engagement adhesive can be applied to at least a portion of one of the pair of pellets or the tether. The engagement adhesive can be applied in a layer having a thickness of at least about 0.5 mm and can remain exposed to the atmosphere after application so as to be operable to adhesively engage the skin or clothing of a subject engaged by the entangling projectile.

In accordance with another aspect of the technology, a method is provided of loading an entangling projectile within a projectile deployment system. The method can include obtaining an entangling projectile, the entangling projectile including a pair of pellets and a flexible tether connecting the pellets. Each of the pellets can be positioned within a socket associated with the projectile deployment system. The tether can be positioned in a tether storage compartment associated with the projectile deployment system. An engagement adhesive can be applied to at least one of the pellets and/or to the tether.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
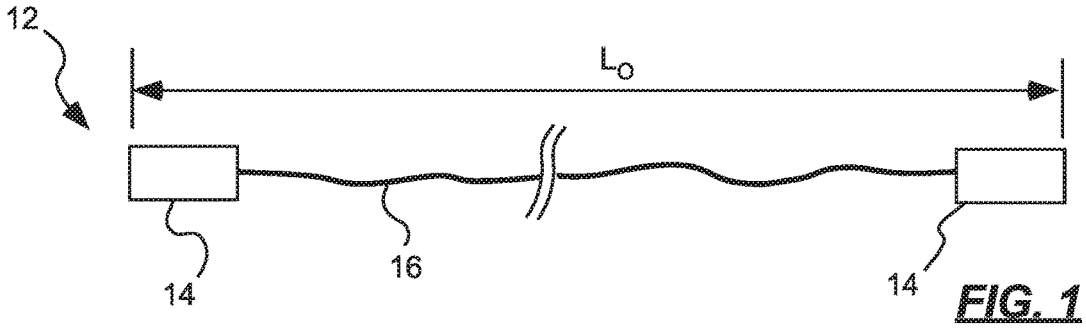
FIG. 1 is a top, bottom, front or rear view of an entangling projectile extended substantially to its full length in accordance with an embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a pellet" can include one or more of such pellets, if the context dictates.

As used herein, the terms "firearm blank" or "blank cartridge" refer to the well-known blank cartridge that can be used with firearms. Such blank cartridges contain gunpowder but not a bullet or shot: as such, they can be discharged to produce only a high velocity pressure wave, without an accompanying shot or slug.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

At least two types of adhesive are referenced herein, including an assembly adhesive, which can be used to assembly various components of the systems described herein. It is generally intended that such assembly adhesive will substantially fully cure after application and no longer remain tacky or uncured. In contrast, an engagement adhesive, as that term is used herein, is typically applied to one or more components of an entangling projectile system with the intent that such adhesive will remain tacky to thereby be able to adhere to a subject that has been engaged with the entangling projectile. Generally, an engagement adhesive remains exposed to contact and is not covered by a component in the same manner in which an assembly adhesive would be "sandwiched" between two components in order to couple those two components one to another.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to non-lethal weapons systems, sometimes referred to as ensnarement or entanglement systems, that can be effectively used as an aid in impeding the progress of or detaining aggressive, fleeing or non-compliant subjects. Devices in accordance with the present technology can be advantageously used to temporarily impede a subject's ability to walk, run, or use his or her arms in cases where law enforcement, security personnel or military personnel wish to detain a subject, but do not wish to use lethal or harmful force or to engage in close proximity, hand-to-hand combat. The technology provides a manner by which the arms or legs of a subject can be temporarily tethered or bound, to the extent that the subject finds it difficult to continue moving in a normal fashion.

While the present technology can be directed at any portion of a subject's body, the following discussion will focus primarily on use of the technology to temporarily tether or bind a subject's legs. It is to be understood, however, that the present technology is not limited to this application. In some cases, multiple portions of the subject's body can be targeted, such as both the arms and the legs.

As shown generally in FIGS. 1-5, the present technology provides an entangling projectile 12 that can be deployed toward a subject's legs to cause the projectile to wrap about the subject's legs. The projectile includes at least one flexible tether 16 and at least two pellets 14, coupled together by the tether. By engaging a subject with the entangling projectile, the subject is temporarily rendered partially or fully incapacitated and thereby restricted in his or her ability to flee or attack. The entangling projectiles of the present technology are launched toward a subject (100 in FIGS. 3A-4) by a launcher. In addition to the launchers discussed herein, numerous examples of suitable launchers are provided, as examples, in the above-referenced related case, U.S. patent application Ser. No. 15/081,440, filed Mar. 25, 2016, which is hereby incorporated herein by reference in its entirety. Such launchers can include energy sources such as compressed gas, explosives/combustibles, mechanical springs, etc.

Generally speaking, a launcher for use with the present entangling projectiles will launch the projectile 12 toward a subject 100 at a relatively high rate of speed. Typically, the projectile can be deployed toward a subject from a distance of between about 6 feet and about 30 feet (1.8 to 9.1 meters), and engages the subject within a matter of about 0.0075 to 0.0375 seconds (traveling at about 800 ft/sec (243.8 m/s)). After being deployed from the launcher, the entangling projectile will wrap about the subject's legs two or three or more times, causing the subject to be temporarily unable to effectively move. As the entangling projectile can be launched from some distance, law enforcement personnel can maintain a safe distance from a subject, yet still be able to effectively and safely temporarily restrain, disable or impede the subject.

Figure 4:
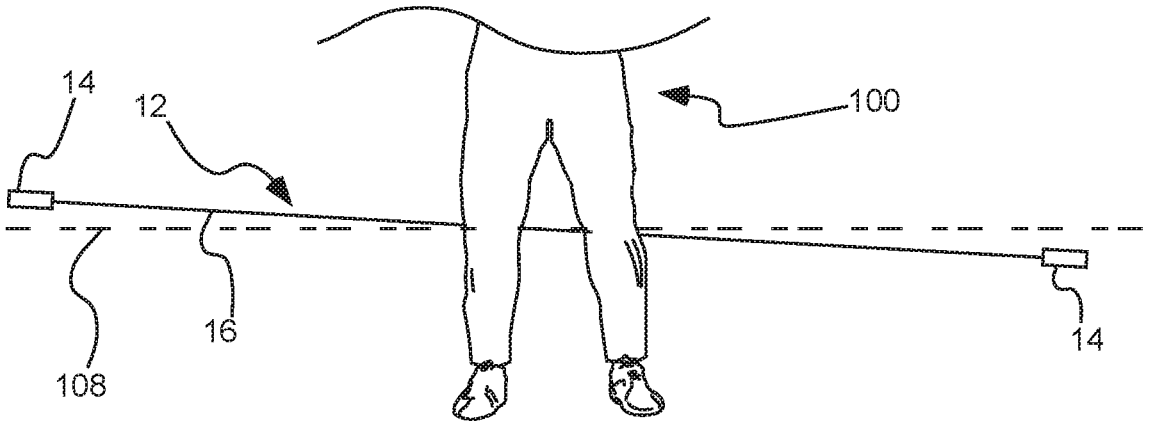
FIG. 4 is a front view of a portion of a subject in accordance with an embodiment of the invention, shown immediately prior to an entangling projectile engaging the subject's legs.

Operation of the entangling projectile is shown generally in FIG. 4: after being released by a launcher, the projectile 12 travels toward a subject 100. As the projectile travels toward the subject, pellets 14 travel away from one another, resulting in the tether 16 being pulled substantially taught between the two. Once the projectile engages the subject (in the example shown in FIG. 4 the subject's legs are engaged), the pellets and tether wrap about the subject and thereby temporarily entangle and/or disable the subject.

A variety of differing pellet and tether combinations can be utilized in the present technology. In the examples shown in FIGS. 1-4, the projectile 12 is shown with two generic pellets 14 connected by a single tether 16. While more than two pellets can be utilized, the examples shown herein include only two. In some embodiments, the invention is limited to two, and only two, pellets connected by a single tether. In one aspect, the invention consists of two pellets and a single tether. In one aspect, the invention consists essentially of two pellets and a single tether. It has been found that limiting the number of pellets to two results in a more effective deployment system: the risk of tangling of the tether 16 is diminished and the pellets spread apart from one another much more cleanly and quickly after being deployed from the launcher. This results in a more consistent trajectory after deployment. This arrangement can also allow, with the proper launcher configuration, the projectiles to be more accurately directed toward a subject.

Figure 5:
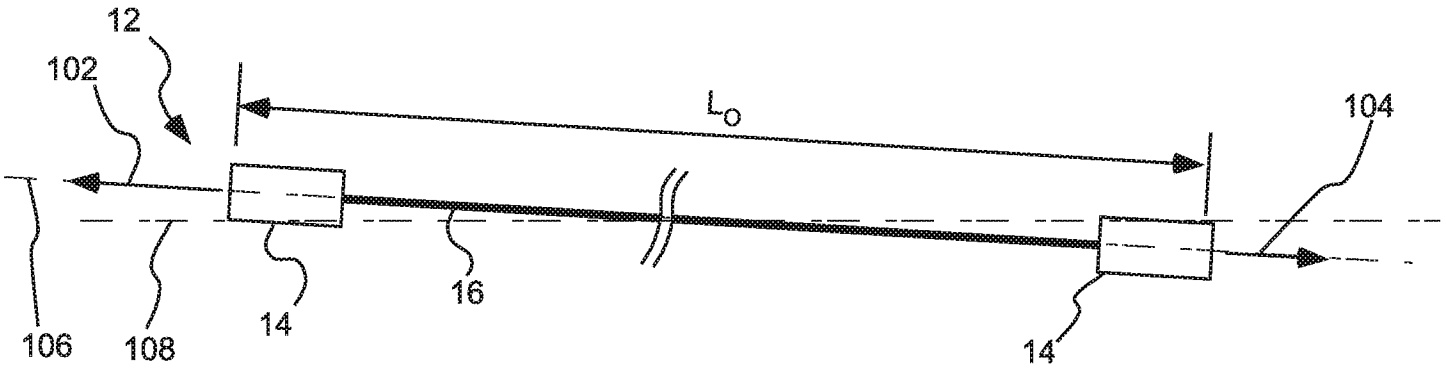
FIG. 5 is a front view of an entangling projectile in accordance with another embodiment of the invention, shown with the pellets pulling the tether into a taught condition.

FIG. 5 illustrates further features of the entangling projectile 12. As referenced above, the projectile includes two pellets 14 coupled on opposing ends of a tether 16. In this embodiment, two and only two pellets are provided, coupled by only a single tether 16. The use of only two pellets has been found to be advantageous in that a much cleaner and accurate projectile can be directed toward a subject, and the projectile can more effectively engage the subject. The pellets 14 can apply equal and opposite forces, shown by example with directional indicators 102 and 104, upon tether 16. In this manner, the tether is pulled into a taught, linear configuration by the force of the pellets traveling away from one another.

The tether 16 can include no additional structure coupled thereto, with no additional structure extending therefrom. In this manner, the pellets 14 can pull the tether into the straight, uninterrupted, linear configuration shown. The tether and pellets can occupy substantially a common plane 106 in the configuration immediately prior to contacting a subject. As shown, this plane 106 is typically angularly offset from "true" horizontal 108, as the pellets are positioned at differing elevations prior to contact with the subject (as detailed further below). By omitting additional pellets or tethers, or other extraneous structure, the present technology can deliver an entangling projectile that engages subjects with a much higher rate of successful engagement.

Figure 2A:
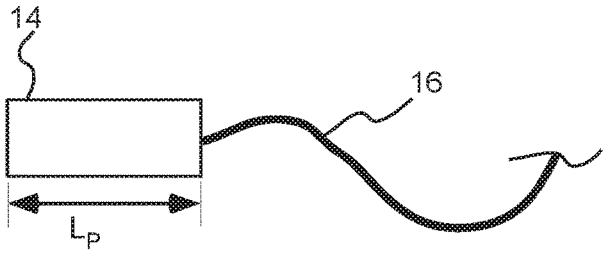
FIG. 2A is a side view of a pellet and a portion of a tether of the projectile of FIG. 1.
Figure 2B:
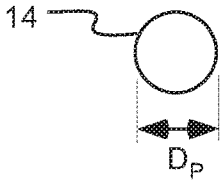
FIG. 2B is an end view of the pellet of FIG. 2A.

FIG. 1 illustrates the projectile 12 extended to its full length "$L_O$." In one embodiment, the overall length of the tether is much longer than the size of pellets ($L_P$, FIG. 2A). The overall length can be on the order of seven feet (2.14 meters) or greater. The pellets can have a length "$L_P$" on the order of an inch (2.54 cm), and a diameter "$D_P$" (FIG. 2B) on the order of ⅜ of an inch (0.95 cm). While differing embodiments of the technology can vary, it is generally desirable to maintain the pellets at a relatively small size to thereby limit the overall size requirements of the projectile casing that houses the pellets prior to deployment and to reduce the impact should a pellet directly contact the subject. In this manner, the technology can be provided in a lightweight, hand-held device.

The relationship of the pellet diameter, weight and length in relation to the tether length/weight can affect the performance of the entangling projectile. It has been found that a pellet diameter of about 0.330 inches (0.84 cm) with a length of about 1 to 1.5 inches (2.54-3.81 cm) with a weight of about 5-6 grams combined with a tether of about 7 feet (2.13 m) weighing about 1 gram provides an effective entangling projectile. The present casing discussed below has been designed to effectively deliver such entangling projectiles with a high degree of precision and reliability.

The tether 16 can be formed from a variety of materials. In one aspect, the tether is formed from conventional nylon material. Waxed cord can also be used, as the wax can aid in packing and/or coiling the tether to properly fit within, and stay within, the tether compartments. In one embodiment, the tether can be formed from an elastic material.

In one example, the tether is formed from Kevlar™ cord, with a thickness of about 0.1 mm. A Kevlar tether has been found to perform well for a number of reasons. The Kevlar tether is very strong, and not as prone to breakage as other cords. In addition, the Kevlar material does not tend to "wick" assembly adhesives as do other materials—thus minimizing drying/curing times of assembly adhesive and reducing the tendency of the cord to become stiff with cured assembly adhesive that have wicked long stretch of cord.

While the present projectiles can be used with variety of launchers, FIGS. 6 through 11 illustrate one exemplary system that can be utilized to effectively direct the entangling projectile toward a subject. As shown in exploded view in FIG. 6, the projectile deployment system 40 generally includes an entangling projectile that includes a pair of pellets 14*a*, 14*b*, and a tether 16 connecting the pellets (note that the tether is omitted from many of these views to enable a clearer description of other components). A projectile casing 44 is provided that can include a pair of sockets 30*a*, 30*b* (see FIGS. 9, 10 and 11, for example). Each socket can be sized and shaped to carry one of the pair of pellets: in the examples shown, socket 30*a* carries pellet 14*a* and socket 30*b* carries pellet 14*b*.

The projectile casing 44 can include a selectively activatable pressure source 50 (FIGS. 8-11). The pressure source can be carried by the projectile casing, independently of the launcher or other components of the system. The pressure source can be capable of expelling the entangling projectile from the projectile casing toward the subject 100. The system can also include a launcher 42 that can carry an activator operable to activate the pressure source to expel the entangling projectile from the projectile casing toward the subject.

The projectile casing 44 can be removably engageable with the launcher 42 to allow removal of the projectile casing from the launcher after expulsion of the entangling projectile 12 from the projectile casing. In this manner, the present technology can provide a deployment system that includes two separate and distinct components: the launcher 42 and the projectile casing 44. In one embodiment, the pellets 14*a*, 14*b* and tether 16 are carried by the projectile casing, as is the pressure source 50. An activator can be carried by the launcher. Generally, all components necessary to power the activator are carried by the launcher, and all components necessary to launch the projectile are carried by the projectile casing. In this manner, the unit as a whole is not operable until the casing 44 and the launcher 42 are functionally engaged with one another. Once the two are engaged with one another, operation of the launcher 42 results in expulsion of the entangling projectile from the casing 44.

As the casing 44 can include all the disposable components of the system, the launcher 42 can have an extended useful life and rarely, if ever, need be replaced or maintained. The entangling projectile 12 and pressure source 50 can be installed within the projectile casing in a controlled environment, thereby ensuring that a clean, effective deployment can be consistently achieved. Projectile casings can be provided to law enforcement personnel loaded and ready to use, requiring only that the personnel insert the projectile casing into the launcher. While it is contemplated that end users of the device could reload the projectile casing with a pressure source and entangling projectile, they are not required to do so and is felt likely that quality can be much better controlled by preloading the projectile casing with both the entangling projectile and the pressure source.

The casing 44 can be held within the launcher 42 in a variety of manners. In one embodiment, the casing can "snap" into the launcher and be firmly held in position by one or more mechanical locks (not shown in detail). The locks can be easily disengaged by an end user when it is desired to remove the casing from the launcher.

Figure 6:
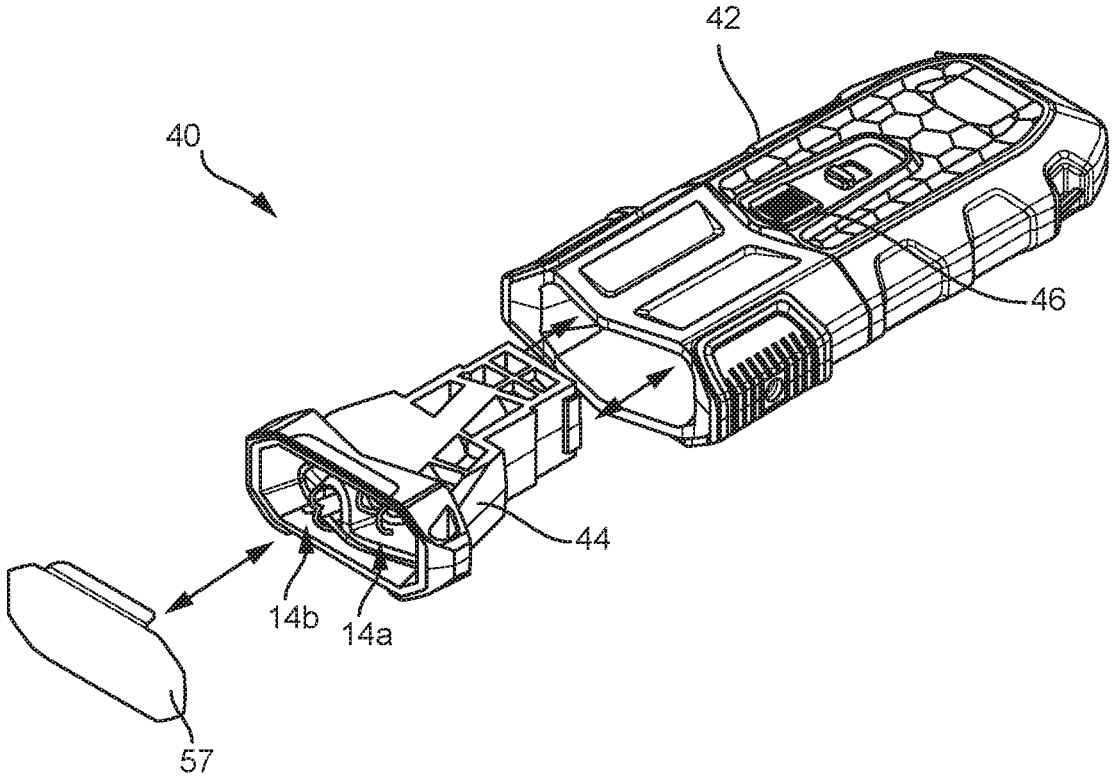
FIG. 6 is a top perspective view of a projectile deployment system of the present invention, shown in an exploded condition with a projectile casing being removed from or installed in a launcher.
Figure 7:
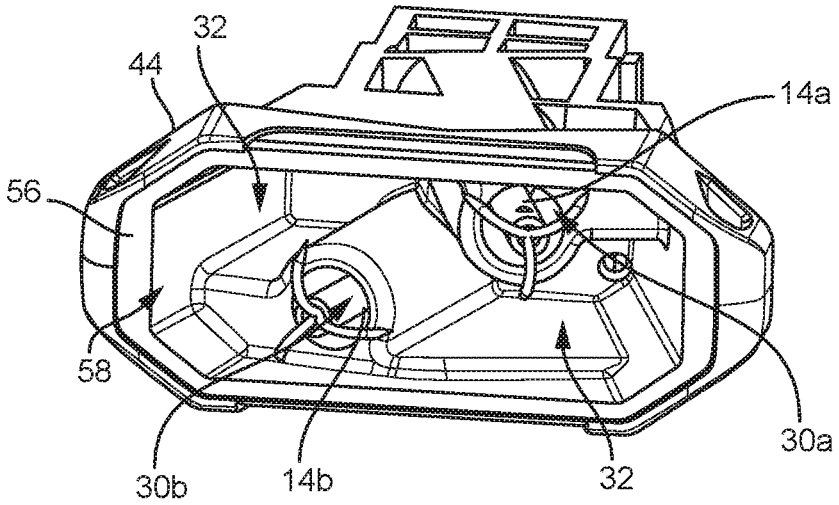
FIG. 7 is a front view of the projectile casing of FIG. 6.
Figure 8:
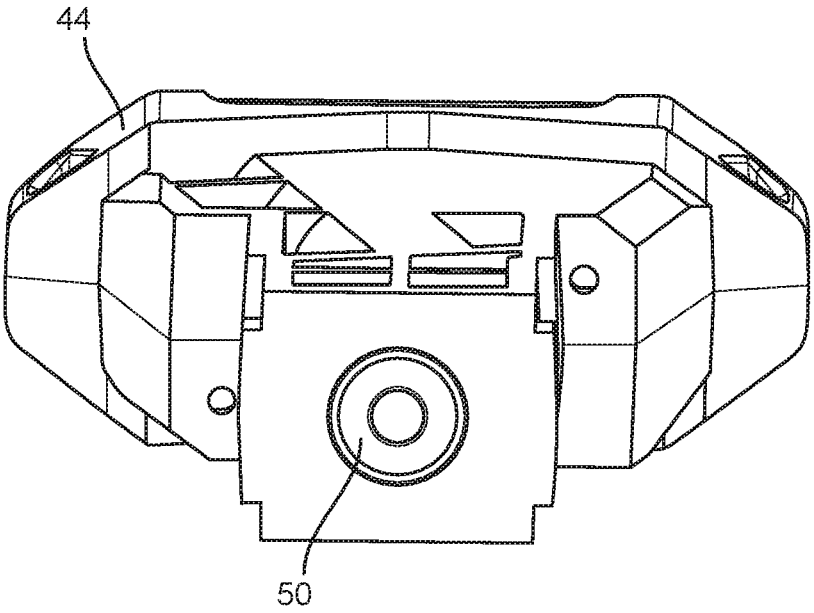
FIG. 8 is a rear view of the projective casing of FIG. 6.

FIG. 7 illustrates a front view of the casing 44. In this view, pellets 14*a*, 14*b* can be seen stored, ready for use, in sockets 30*a*, 30*b*, respectively. One or more tether storage compartment(s) 32 can be provided and can consist of shaped depressions formed in the projectile casing to allow the tether (not shown in this view) to be stored adjacent the pellets prior to use. The projectile casing can include a front shoulder 56 that can serve to create a protective pocket 58 around the tether and the pellets. As shown in FIG. 6, a cover 57 can be applied over the pocket 58 and can be attached to the shoulder 56 to protect the pocket from exposure to contaminants and/or to contain the entangling projectile within the projectile casing.

In the examples shown in FIGS. 6-11, the pressure source 50 comprises a cartridge blank. This type of pressure source is well known to contain gunpowder that is typically activated by striking a primer formed in the cartridge. The blank cartridge contains no slug; deployment of the cartridge results only in a high-pressure wave being directed from the projectile casing. This high-pressure wave is utilized by the present technology to propel the entangling projectile from the system at high velocity. In one embodiment of the invention, the cartridge blank can be irremovably attached to the cartridge such that the cartridge is a single actuation cartridge. In this manner, installation of the cartridge can be done in a controlled manufacturing environment, to ensure the proper cartridge is used, that the cartridge is properly installed, and that the casing 44 is otherwise ready for use. The cartridge can be secured to the casing by assembly adhesive, mechanical crimp, etc.

By irremovably attaching the cartridge blank 50 to the casing 44, there is little to no risk that an actual bullet or "real" cartridge can be accidentally inserted into the casing. In addition, a length and configuration of the central bore 60 (FIGS. 9 and 10) can be configured to prevent the insertion of anything other than a properly designed blank cartridge 50.

In contrast, the entangling projectile 12 is removably installed within the projectile casing. All components of the entangling projectile (i.e., the pellets 14*a*, 14*b* and tether 16) are installed within the casing such that they can be readily and completely ejected from the casing when the pressure source 50 is deployed. The geometry of the sockets 30*a*, 30*b* within the casing 44, along with the geometry of the pellets, has been carefully designed to ensure that a consistent, effective deployment of the entangling projectile is achieved each time the launcher is activated.

Figure 9:
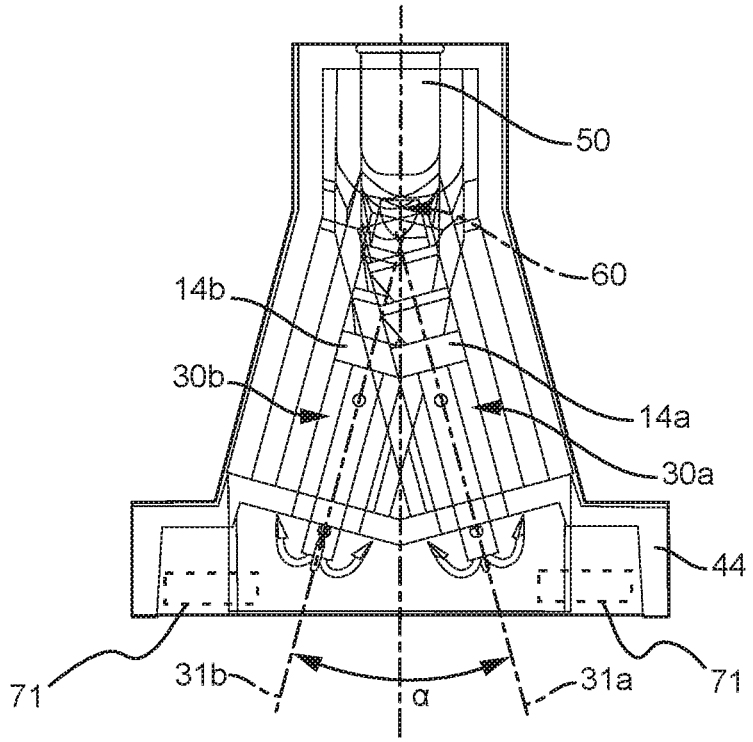
FIG. 9 is a top, partially sectioned view of the projectile casing of FIG. 6.

A shown in top view in FIG. 9, the sockets 30*a* and 30*b* can be angled relative to one another such that the pellets 14*a*, 14*b* travel apart from one another as they are expelled from the projectile casing 44. In the example shown, at least a portion of one of the sockets extends beneath a portion of another of the sockets within the cartridge (in this example, "bottom" socket 30*b* extends beneath "upper" socket 30*a*). Depending upon the particular arrangement, one of the pellets can overlap, or extend beneath or above, another of the pellets when the pellets are installed within the sockets. In the example shown, pellet 30*b* extends beneath (when viewed perpendicularly from a horizontal plane on which the casing sits) pellet 30*a* when the pellets are stored and ready for activation. As shown in side view in FIG. 10, in one example, the sockets can also be, or can alternatively be, vertically offset relative to one another and can extend in planes parallel to one another.

Figure 10:
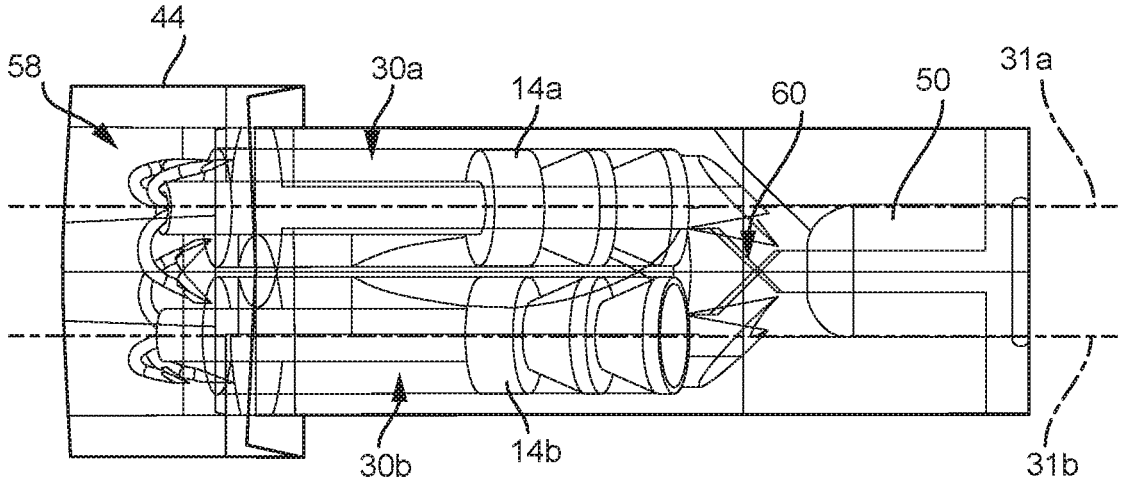
FIG. 10 is a side, partially sectioned view of the projectile casing of FIG. 6.
Figure 11:
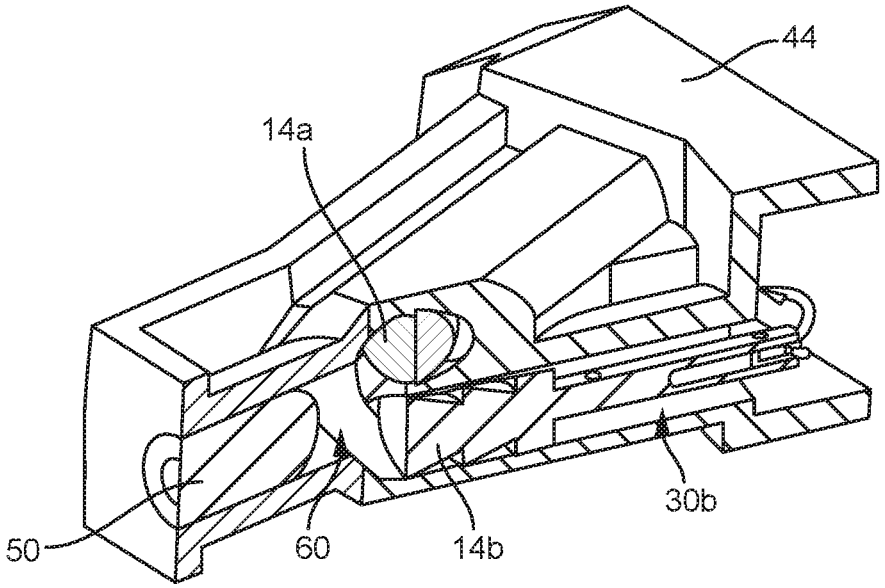
FIG. 11 is another side, partially sectioned view of the projectile casing of FIG. 6.

The casing 44 can also include a central bore 60, shown in FIGS. 9-11, located immediately adjacent the discharge end of pressure source or blank cartridge 50. In this embodiment, upon activation, the blank cartridge 50 discharges into the central bore a high-pressure wave. This high-pressure wave then travels into both sockets 30*a* and 30*b*, generally distributed equally among the two. Thus, each of socket 30*a* and socket 30*b* terminate into, or are at least in fluid communication with, central bore 60.

As discussed, each of socket 30*a*, 30*b* can hold one pellet, 14*a*, 14*b*, respectively, prior to deployment of the pellets from the projectile casing. As a high-pressure wave is generated by the cartridge, it is directed through the central bore and is applied to the pellets held in sockets 30*a*, 30*b*. The pellets are then forcibly expelled from the inner block toward the subject.

As best appreciated from FIG. 9, the sockets 30*a*, 30*b* can be oriented at an angle "α" relative to one another. While the angle can vary, it is generally an acute angle, typically ranging from about 10 degrees to about 60 degrees. In another embodiment, the angle can range between about 25 degrees to about 45 degrees. In another embodiment, the angle is about 30 degrees. By angling the sockets relative to one another, the pellets 14*a*, 14*b* are directed away from one another as they are expelled from the sockets. In this manner, the pellets separate relative to one another very quickly, pulling the tether 16 taut between them so that the tether can fully extend prior to engaging the subject. The forward energy applied to the pellets is both split between the two pellets and angled by the nature of the sockets: as such, in the event that a pellet inadvertently directly contacts a subject, the force is less than that otherwise applied by a full charge, minimizing the risk of injury to the subject.

Figure 3A:
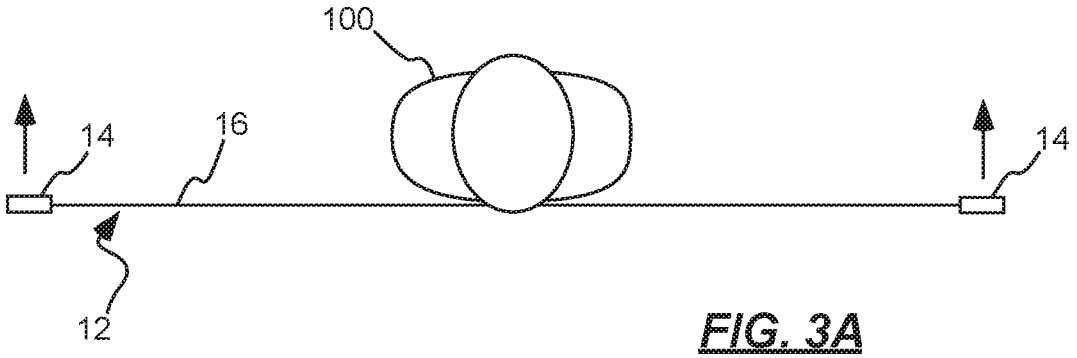
FIG. 3A is a top view of a subject toward which an entangling projectile was launched, shown immediately prior to the entangling projectile engaging the subject.
Figure 3B:
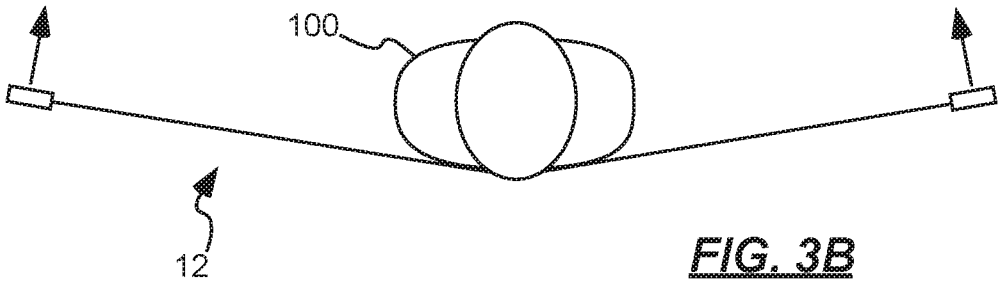
FIG. 3B is a top view of the subject and projectile of FIG. 3A, shown shortly after the entangling projectile engaged the subject.

The resulting launch is shown in FIGS. 3A and 3B. In FIG. 3A, the entangling projectile 12 has been launched toward a subject 100 (shown from above) and has traveled to engage the subject. Prior to contacting the subject, the tether 16 has been pulled taut, such that the pellets 14 are travelling in a linear direction toward the subject. Immediately after the tether 16 contacts the subject, the momentum of the pellets, prevented by the tether from continuing along their present trajectory, causes them to begin moving toward one another (shown in FIG. 3B), which momentum will cause the pellets to orbit about the subject.

As the pellets orbit about the subject's legs, the tether wraps itself tightly about the subject's legs. Note that, as the tether wraps about the subject's legs, the rotational velocity of the pellets will increase, causing them to wrap more quickly as the effective length of the tether is decreased. In an average deployment, the pellets will wrap themselves about the subject's legs 2-3 times, resulting in the tether being wrapped about the subject's legs 4-6 times. As will be appreciated, a subject will at least temporarily have great difficulty moving after the tether is thus wrapped about his or her legs.

Referring again to FIG. 9, in this example the axes 31*a*, 31*b* of the sockets 30*a*, 30*b*, respectively, can intersect one another at a location within the casing 44. That is, a portion or section of one of the sockets can intersect with a portion or section of the other socket within the confines of the casing. In the example shown, sockets 30*a* and 30*b* intersect or overlap where each socket is fluidly coupled to central bore 60. The sockets can also be stacked horizontally relative to one another, to provide an overlapping configuration of one atop the other. In this manner, the sockets can be spaced relatively close to one another while also maintaining a desired angle between the two, and/or a desired separation distance between the two to prevent the pellets from colliding with one another. The location at which the sockets intersect can be adjusted nearer to or further from the central bore.

This stacking/overlap configuration allows the use of a relatively narrow projectile casing 44 regardless of the angle at which it is desired to orient the sockets. If the sockets were merely oriented in a side-by-side relationship, without overlapping axes, the width or diameter of the projectile casing would have to be increased as the angle "α" between the socket axes 31 was increased. By overlapping the axes, however, this limitation in arranging the sockets is eliminated. This can allow the projectile casing to be much narrower than otherwise possible. This results in a launcher system that can be easily carried by law enforcement personnel, similar to conventional firearms or Taser. While not so limited, in one aspect of the invention, the projectile casing 44 can be formed having a diameter or maximum width of less than about two inches (5.1 cm), and as little as 1 ½ inches (3.8 cm) or less. The projectile casing can be formed with a length of less than about 2 ½ inches (6.4 cm), or as little as two inches (5.1 cm) or less. Overlapping or stacking of the sockets also allows a vertical displacement of the pellets to differ as the pellets contact the subject. This vertical offset of the pellets is discussed in more detail in the parent applications referenced above.

In addition to utilizing a blank cartridge as the pressure source 50, the pressure source can be provided in a number of other forms. In one example, the pressure source includes a compressed gas cylinder that can be activated in much the same way as discussed in relation to the blank cartridge. In other embodiments, an electronic triggering system can be utilized.

By packaging the pressure source 50 and the entangling projectile 12 in the removable projectile casing 44, all of the components that generate force (and react to force) are contained in a single unit. There are no unnecessary gaps or connections between the power source and the entangling projectile. This aspect also eliminates any need to reload two parts, the entangling projectile and the pressure source, as these are contained within one removable part, the projectile casing, which can be easily and quickly loaded into or unloaded from the launcher 42.

Figure 12A:
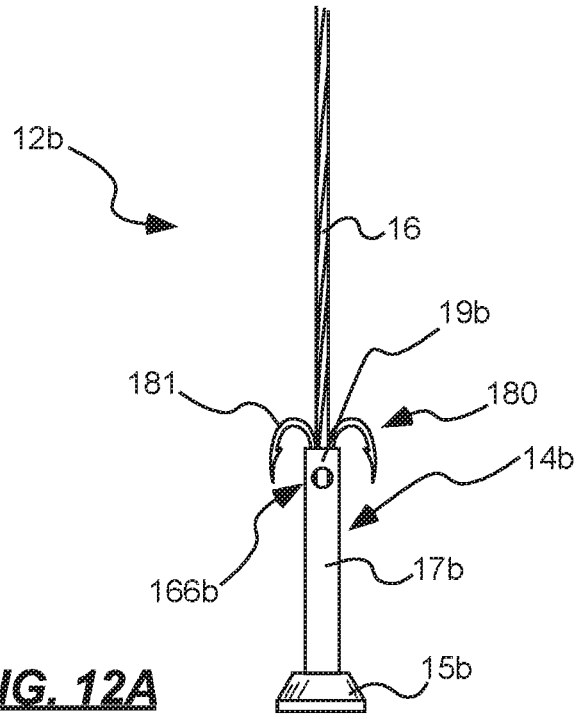
FIG. 12A is a side view of a pellet in accordance with an embodiment of the invention.

FIG. 12A illustrates a portion of one exemplary entangling projectile 12*b* in accordance with an embodiment of the invention. In this example, pellet 14*b* is provided that includes various features that aid in more accurately and effectively engaging a subject. Pellet 14*b* can include a head portion 15*b*, a shank 17*b* and a tail portion 19*b*. A portion of tether 16 can extend into the shank near the tail portion. Access hole 166*b* can be formed through the shank so that the tether can be secured to the shank by the use of assembly adhesive applied through access hole 166*b*. A hook assembly 180 can be attached atop the shank of the pellet, and can also be secured to the shank via application of assembly adhesive through access hole 166*b*.

The entangling projectile 12*b* shown in FIG. 12A is but one example of the various types of projectiles that can be used with the present invention. Further examples are provided in the above-referenced parent case, U.S. patent application Ser. No. 15/399,537, which is hereby incorporated herein by reference. The hook assembly 180 can include one or more hooks 181, which hooks can take a variety of forms. In the examples shown in the figures, the hooks extend from the shank in a direction toward the tether (as referenced when the entangling projectile is extended), arc away from the tether and extend back toward the head end of the pellet. The hooks in this example can include a configuration very similar to hooks used for fishing (for example, a treble hook configuration).

The engagement hook can be operable to engage clothing worn by a subject 100 engaged by the entangling projectile to aid in retaining the entangling projectile about the subject. The engagement hook can also engage, during or after completion of the wrap, another engagement hook. The present inventors have found that, while wrapping the present projectiles about a subject has proven effective, the use of engagement hooks on the pellets can aid in retaining the projectile about the subject after the projectile has wrapped, increasing the likelihood of a successful entangling engagement or wrap. The present engagement hooks are designed to engage clothing worn by the subject (or to engage other hooks of the projectile), not necessarily the subject's skin or body. In some embodiments, engaging the subject's skin or body with hooks is undesirable, while in other embodiments, such a consideration may not be as critical (when very small hooks are used, for example).

While the various engagement hooks illustrated in the figures include a conventional "hook" shape, it is to be understood that the hooks can include linear segments that extend from the pellet in a variety of directions. For example, a hook can include a straight segment that extends perpendicularly from the pellet in one direction, and then turn at an angle in another direction. In other words, the hooks need not contain curved portions—they can include one or more linear segments formed at angles relative to one another. The hooks can also extend directly from the pellet in a unitary direction, and need not include segments that extend in different directions. The hooks can include or can comprise spikes, barbs, claws, etc.

Figure 12B:
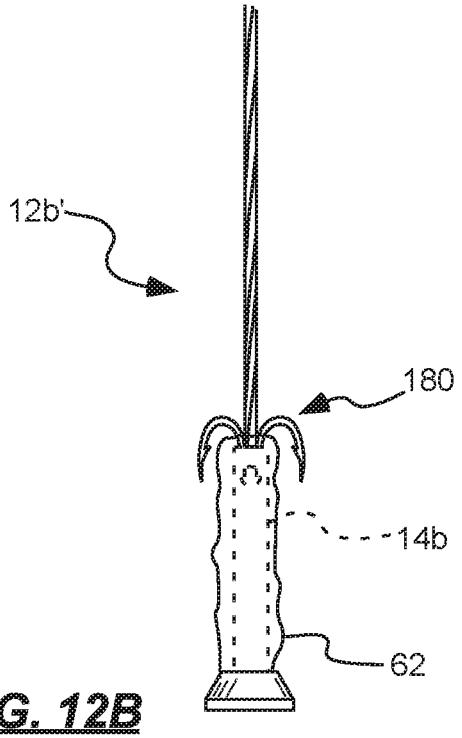
FIG. 12B is a side view of the pellet of FIG. 12A, with an engagement adhesive applied thereto.

FIG. 12B illustrates another embodiment of the technology in which an engagement adhesive 62 is applied to all or a portion of the entangling projectile 12*b*', in this case pellet 14*b*. The engagement adhesive can aid in creating or maintaining engagement with a subject engaged by the entangling projectile. The type of engagement adhesive used can vary for particular applications, however in one embodiment the engagement adhesive is a commercially available bulk adhesive sold under the tradename Catchmaster Bulk Glue, BG-1. This type of adhesive is generally known in the art as a permanently tacky polymeric adhesive that typically retains its tackiness for very long periods of time, on the order of a year or more. Such adhesives are used, for example, for adhesives in rodent traps and the like.

The present inventors have found that this type of engagement adhesive will aid in providing a secure interface between the entangling projectile and a subject to be subdued with the entangling projectile. This is accomplished as the engagement adhesive aids in securing the pellet and/or tether of the entangling projectile against the subject, thereby impeding unwinding or removal from the subject either by movement or other activity. Increased engagement with, or attachment to, the subject increases the effectiveness of the entangling projectile in impeding or restricting movement of the subject. As this type of adhesive can maintain efficacy for a long period of time after being applied to the entangling projectile, entangling projectiles treated with the adhesive can enjoy very long shelf lives. As the adhesive exhibits a relatively high degree of viscosity, the adhesive will remain in position as applied to the pellets and/or tether for similarly long periods of time, without running or sloughing off the pellet or tether over time.

As discussed in further detail below, the engagement adhesive can be applied, in varying amounts and to varying positions on, the pellets of the entangling projectile and/or to the tether of the entangling projectile. The adhesive can effectively engage clothing of a subject as well as bare skin of the subject without significantly damaging either. This aspect has been found advantageous for use with subjects that are not fully covered by clothing (e.g., subjects wearing short pants or not wearing a shirt). The present inventors have found that the engagement adhesive is sufficient, on its own, to secure the entangling projectile about a subject for sufficiently long periods of time. This aspect has also been found advantageous for training purposes to illustrate a secure wrap of the entangling projectile about a subject without the use of hooks or hook assemblies as described below. Without engagement adhesive or hooks there is a tendency for the weight of the pellets to cause the entangling projectile to more quickly disengage from the subject.

In some embodiments, hooks or hook assemblies are utilized with or on the entangling projectile in addition to the engagement adhesive, e.g., hook assembly 180. In these cases, the hooks and the adhesive complement one another to form a more effective entangling projectile. In such cases, the adhesive can serve to maintain the pellets and/or tether in contact with the subject for at least a brief period of time to better allow the hooks or hook assembly to fully engage clothing worn by the subject. Thus, in cases where the adhesive alone may not be ideal to fully engage a subject, the engagement adhesive augments the performance of hooks used in conjunction with the entangling projectile.

Figure 17:
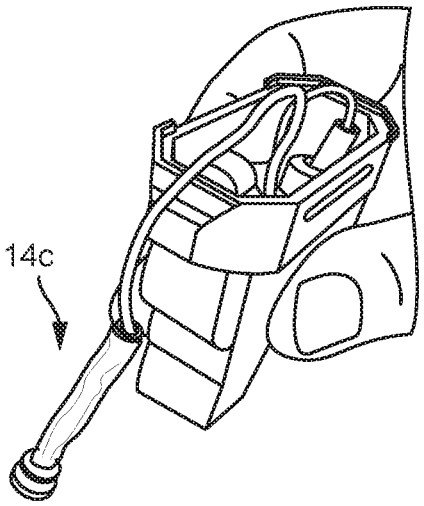
FIG. 17 is a perspective view of a projectile casing with an entangling projectile partially loaded therein.
Figure 18:
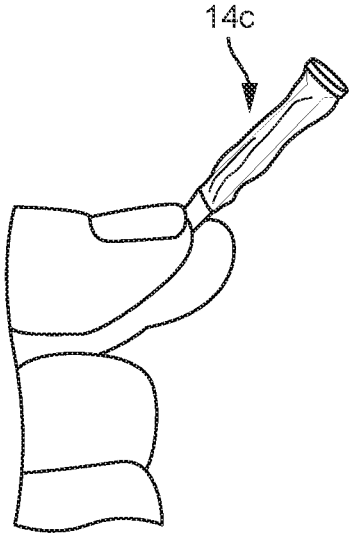
FIG. 18 is a perspective view of a pellet of an entangling projectile, the pellet having an engagement adhesive applied thereto.

The engagement adhesive 62 can be applied to the pellet and/or the tether of the entangling projectile in a number of manners. In the example shown in FIG. 12B, the adhesive 62 is applied to substantially all of the pellet 14*b* prior to installation of the pellet into a launcher, for example into sockets 30*a*, 30*b* of casing 44. FIGS. 17 and 18 illustrate similarly treated pellets 14*c*. In some embodiments, all or nearly all of the shank of the pellet can be treated with adhesive, with the head portion of the pellet remaining untreated.

Figure 13A:
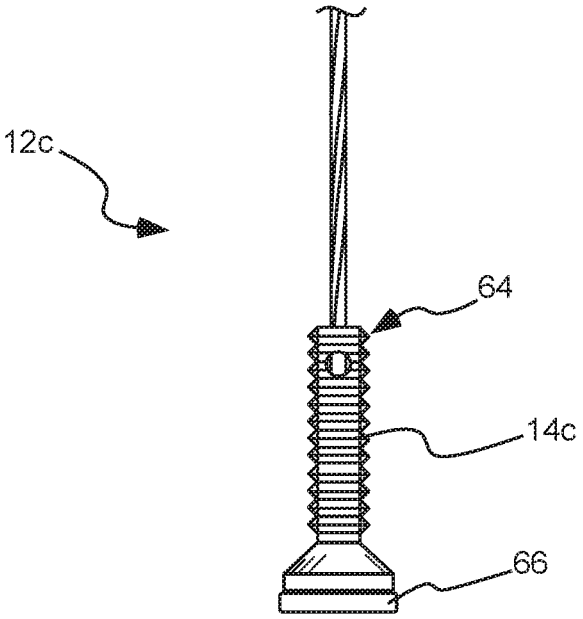
FIG. 13A is a side view of a pellet in accordance with an embodiment of the invention.
Figure 13B:
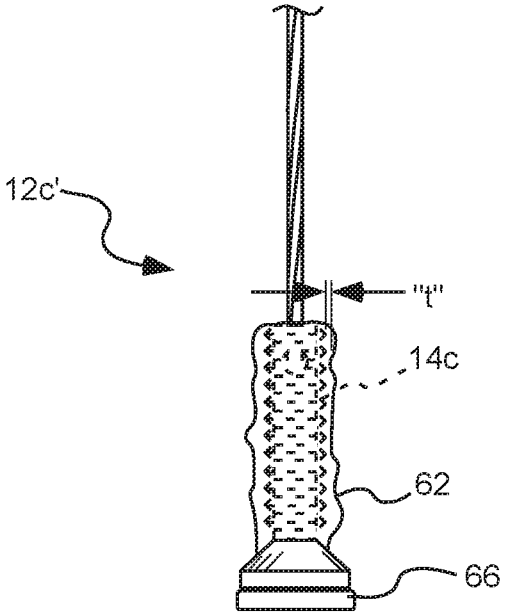
FIG. 13B is a side view of the pellet of FIG. 13A, with an engagement adhesive applied thereto.

FIG. 13A and 13B illustrates the pellet 14*c* in accordance with another embodiment of the present invention. In this example, the pellet includes a series of surface features 64 that can aid in retaining the engagement adhesive about the pellet. The surface features can include a series of peaks and valleys, similar to threads, as shown, or can include a series of corrugations, pits, spikes, depressions, etc. By increasing the available surface area on the pellet, the surface features can increase the tendency of the engagement adhesive to remain in place on the pellet. FIG. 13B illustrates the projectile 12*c*' with pellet 14*c* having engagement adhesive 62 applied thereabout.

In some aspects of the technology, the engagement adhesive 62 can be applied in a layer having a thickness much greater than typically used with assembly adhesive. Typical bond lines used when assembling components are on the order of 0.001 inches to 0.007 inches (0.025 mm to 0.178 mm). In contrast, the present entangling adhesive can be applied having a thickness ("t" in FIG. 13B) of about 0.5 mm or greater. This can ensure that sufficient adhesive is carried by the pellet (or tether) to engage a subject. Generally, the engagement adhesive remains uncovered by structure after application: that is, it remains exposed to the surrounding atmosphere. Despite this, the adhesive can remain tacky (e.g., can still provide the desired adhesive qualities) for long periods of time after application, on the order 6 to 12 months or longer.

Figure 14:
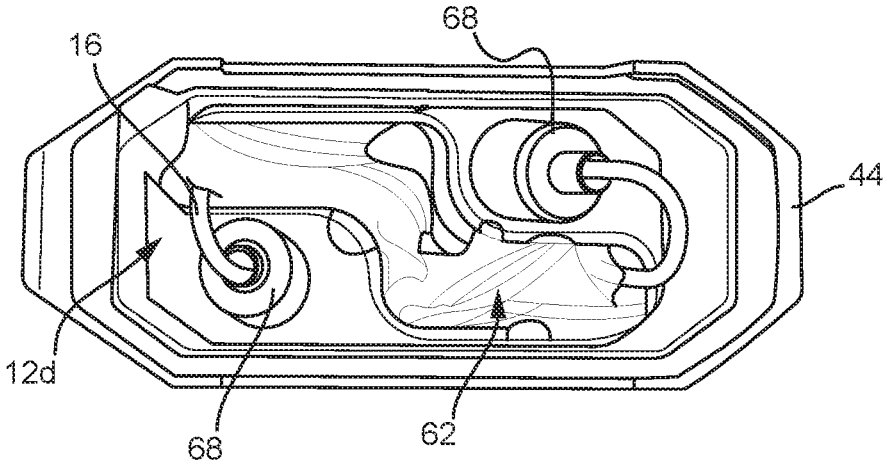
FIG. 14 is an end view of a projectile casing in accordance with an embodiment of the invention, with an entangling projectile loaded therein with an engagement adhesive applied thereto.

FIG. 14 illustrates an exemplary manner by which engagement adhesive can be applied to an entangling projectile 12*d*. In this instance, engagement adhesive has already been applied to the pellets of the entangling projectile, and those pellets have been positioned in sockets within a projectile casing 44. Tether 16 has been stored within tether storage compartment(s) (e.g., 32 in FIG. 7), with no adhesive applied to the tether pre-installation. After installation within the tether storage compartments, an engagement adhesive 62 is applied in a layer across the exposed portions of the tether. In this manner, adhesive is applied only to sections or portions of the tether: that is, those sections positioned across the top of the storage compartment.

Figure 15:
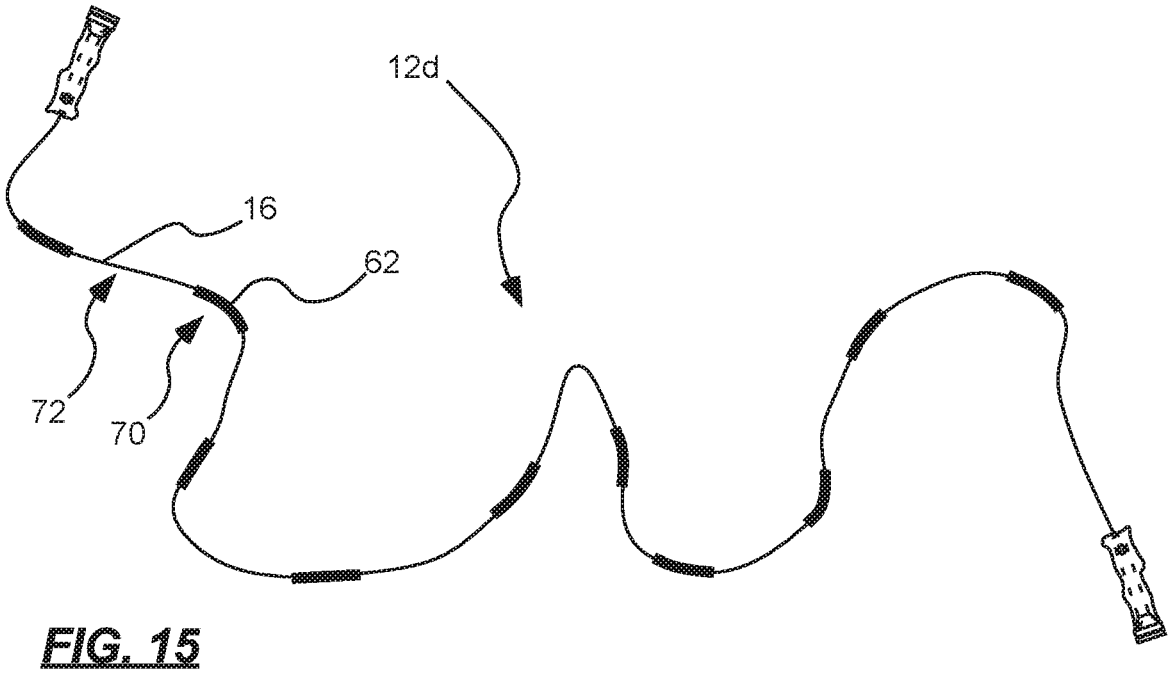
FIG. 15 is a top view of the entangling projectile of FIG. 14, shown in a partially extended configuration.

FIG. 15 illustrates the entangling projectile 12*d* after removal from the projectile casing 44. Note that this illustration is of the projectile in a loose, relaxed configuration—the projectile is not shown in the engaged or taught configuration that it would assume after being launched. As will be appreciated, application of the adhesive as explained above results in the tether 16 having a series of sections 70 carrying adhesive separated by a series of sections 72 to which adhesive is not applied. The present inventors have found that an entangling projectile tether treated in such a manner provides a sufficient engagement profile to securely engage a subject without requiring the entire tether be treated with adhesive. Applying the adhesive to only the upper, exposed portions of the tether while stored in the casing also greatly simplifies the process of applying the adhesive to the tether as well as limiting the amount of adhesive required. This process can also provide a projectile that is more easily propelled or deployed from a launcher or cartridge or casing.

As also shown in FIG. 14, in some embodiments of the technology, a centering disk or shroud 68 can be attached to or carried by the pellets to aid in centering the shank of the pellet within a socket. U.S. patent application Ser. No. 16/015,932, filed Jun. 22, 2018, provides further detail on this concept, and is hereby incorporated herein by reference in its entirety.

Figure 16:
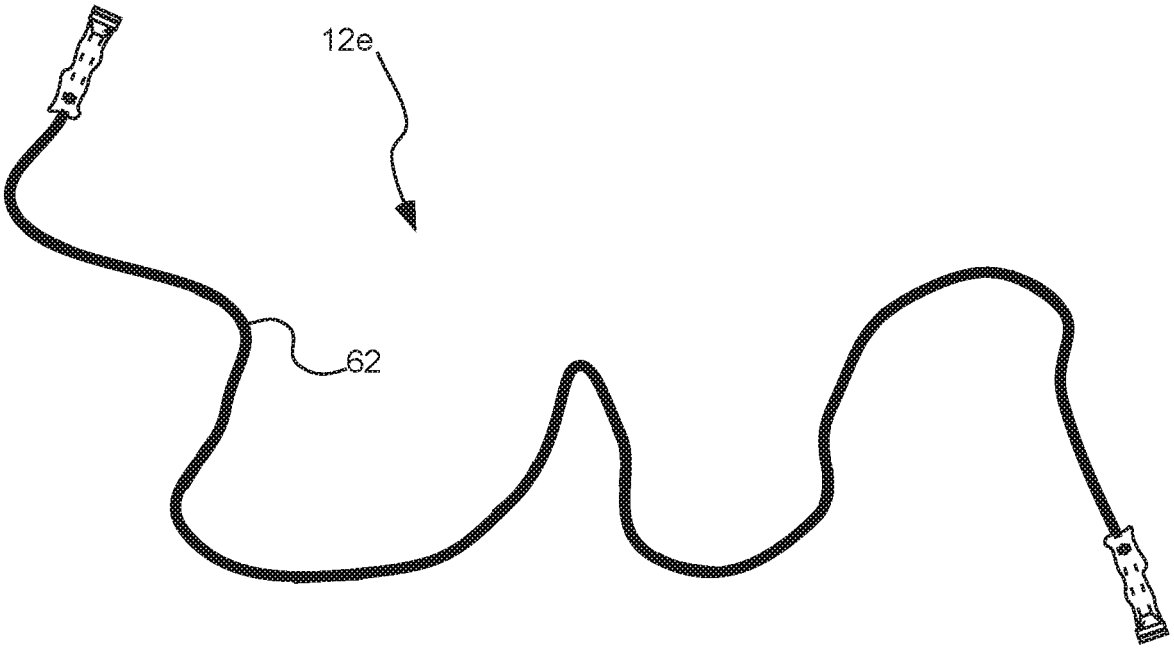
FIG. 16 is a top view of another entangling projectile in accordance with the present technology, shown in a partially extended configuration.

FIG. 16 illustrates another exemplary embodiment of the technology in which tether 12*e* is substantially fully coated with engagement adhesive 62. Application of adhesive to the pellets and/or the tether can be accomplished in a number of manners in addition to those described above. FIG. 9 illustrates schematically adhesive application modules 71 that can be incorporated into casing 44 to apply adhesive to the pellets and/or tether as the entangling projectile is launched from the casing. Thus, in this embodiment, the tether and pellets are installed within the casing "dry," or untreated with adhesive, and adhesive is applied to the pellets and/or the tether during deployment of the tether and pellets. This process can be used to fully or partially treat each of the tether and/or pellets. The application modules can also be used to apply a component of an adhesive, e.g., a hardener or other catalyst, to activate or otherwise treat an adhesive already carried by the pellets and/or tether.

FIGS. 13A and 13B illustrate a further feature of the technology in which a seal 66 is carried by pellet 14*c*. In this example, the seal is coupled to a far end of the head of the pellet. The seal can be formed from a relatively pliable material, such as a felt or a fibrous material, or a polymeric material. The seal provides a number of advantages. It can serve to seal the socket upstream of the pellet, to avoid "blow-by," which can decrease the velocity at which the pellet is deployed from the socket. In addition, the seal can prevent debris carried by the pressure source (e.g., powder and related debris created when firing the launcher) from contaminating the assembly adhesive 62 carried by the pellet.

While much of the discussion above focused on the projectile casing and launcher used in the present technology, the ballistic features of the entangling projectiles must be carefully matched with the operable features of the casing and launcher. Generally, the entangling projectiles of the present technology are provided as electrically inert. That is, they are not attached to an electrical charge source, nor do they require an electrical charge to subdue or entangle a subject. As used herein, the term "electrically inert" is understood to refer to a condition in which the projectiles, and pellets and tether, do not carry an electrical charge other than that carried by inert objects within the environment in which the projectiles are deployed. Thus, while some static charge may be carried by most objects in such an environment, the projectiles (pellets and tether) do not carry any additional charge. In most embodiments, the tether and pellets similarly need not carry any other structure capable of delivering an electrical charge to a subject.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. An entangling projectile for use in a projectile deployment system, the entangling projectile comprising:

a pair of pellets, at least one of the pair of pellets including a shank having a series of peaks and valleys formed in the shank;

a flexible tether connecting the pellets; and an engagement adhesive applied to the series of peaks and valleys formed in the shank of the at least one of the pair of pellets, the engagement adhesive operable to adhesively engage skin or clothing of a subject engaged by the entangling projectile.

2. The projectile of claim 1, further comprising at least one engagement hook assembly coupled to at least one of the pellets, the engagement hook assembly including one or more engagement hooks operable to engage clothing worn by a subject engaged by the entangling projectile to aid in retaining the entangling projectile about the subject.

3. The projectile of claim 1, further comprising a pad applied to an end of at least one of the pair of pellets, the pad having an outside diameter substantially matching an outside diameter of the end of the at least one of the pair of pellets to which the pad is applied.

4. The projectile of claim 1, wherein the engagement adhesive has a thickness of at least about 0.5 mm.

5. The projectile of claim 1, wherein the engagement adhesive remains exposed to the atmosphere after application to the at least one of the pair of pellets.

6. The projectile of claim 1, wherein the engagement adhesive is applied to only the shank of the at least one of the pair of pellets while a head end of the at least one of the pair of pellets remains free of engagement adhesive.

7. A method of loading an entangling projectile within a projectile deployment system, the method comprising:

obtaining an entangling projectile, the entangling projectile including a pair of pellets and a flexible tether connecting the pellets;

positioning each of the pellets within a socket associated with the projectile deployment system;

positioning the tether in a tether storage compartment associated with the projectile deployment system; and applying an engagement adhesive to only portions of the tether exposed at a top of the tether storage compartment after positioning the tether in the tether storage compartment.

8. The method of claim 7, further comprising applying the engagement adhesive to the pellets prior to positioning the pellets within the sockets.

9. The method of claim 8, wherein applying the engagement adhesive to the pellets comprises applying the engagement adhesive to a shank of the pellet while a head end of the pellet remains free of engagement adhesive.

10. A method of loading an entangling projectile within a projectile deployment system, the method comprising:

obtaining an entangling projectile, the entangling projectile including a pair of pellets and a flexible tether connecting the pellets;

positioning each of the pellets within a socket associated with the projectile deployment system;

positioning the tether in a tether storage compartment associated with the projectile deployment system; and applying an engagement adhesive to a shank of at least one of the pair of pellets while a head end of the at least one of the pair of pellets remains free of engagement adhesive.

11. The method of claim 10, wherein applying the engagement adhesive comprises applying the engagement adhesive to the shank of the at least one of the pair of pellets prior to positioning the at least one of the pair of pellets within a socket.

12. The method of claim 10, further comprising applying the engagement adhesive to only portions of the tether exposed at a top of the tether storage compartment after positioning the tether in the tether storage compartment.

* * * * *